United States Patent [19]

Mania

[11] Patent Number: 5,035,352

[45] Date of Patent: Jul. 30, 1991

[54] ADJUSTABLE APPARATUS FOR SPREADING MORTAR AND METHOD THEREFOR

[76] Inventor: Frank Mania, 12408 N. 29th Pl., Phoenix, Ariz. 85032

[21] Appl. No.: 385,935

[22] Filed: Jul. 25, 1989

Related U.S. Application Data

[63] Continuation-in-part of Ser. No. 164,438, Mar. 4, 1988, abandoned.

[51] Int. Cl.[5] ..... B05C 5/00

[52] U.S. Cl. ..... 222/611.2; 222/129; 222/190; 222/609; 222/611.1; 222/613; 222/614; 222/618; 222/623; 222/625; 401/5; 401/171; 401/176; 401/193; 425/87; 425/458

[58] Field of Search ..... 222/129, 134, 163, 167, 222/169, , 190, 608-609, 611.1, 611.2, 613-614, 618, 622, 623, 625, 626, 386; 401/4, 5, 28, 48, 193, 171, 176; 425/87, 458

[56] References Cited

U.S. PATENT DOCUMENTS

| | | | |
|---|---|---|---|
| 915,661 | 3/1909 | Covington . | |
| 1,125,146 | 1/1915 | Maskrey et al. . | |
| 1,158,460 | 11/1915 | Doll . | |
| 1,374,881 | 4/1921 | Copeland | 222/623 X |
| 1,780,902 | 11/1930 | Ainslie . | |
| 2,674,116 | 4/1954 | Erp . | |
| 2,683,981 | 7/1954 | Richey | 401/193 X |
| 2,758,468 | 8/1956 | Searl . | |
| 3,045,312 | 7/1962 | Tolbert et al. . | |
| 3,148,432 | 9/1964 | Garnett, Jr. . | |
| 3,162,886 | 12/1964 | Wise | 401/193 X |
| 3,451,757 | 6/1969 | Stroud | 401/171 X |
| 3,791,559 | 2/1974 | Foye | 222/611 |
| 3,826,410 | 7/1974 | Meyer | 222/611 X |
| 3,831,819 | 8/1974 | Bloom | 222/611 |
| 3,887,114 | 6/1975 | Villanovich | 222/611 X |
| 4,135,651 | 1/1979 | Hession et al. | 222/611 |
| 4,294,383 | 10/1981 | Hession et al. | 222/611 |
| 4,352,445 | 10/1982 | Cusumano et al. | 222/611 |
| 4,516,868 | 5/1985 | Molnar | 401/5 |

*Primary Examiner*—Kevin P. Shaver
*Assistant Examiner*—Boris Milef
*Attorney, Agent, or Firm*—Victor Flores; Harry M. Weiss

[57] ABSTRACT

This invention discloses an adjustable apparatus for spreading mortar onto bricks or blocks. The apparatus utilizes augers and is readily adjusted to extrude beads of mortar onto the proper portions of bricks/blocks having different widths. A trowel member is provided on the extrusion ports to smooth the beads of mortar. The apparatus includes a lid member that contains water for wetting the mortar. The weight of the lid member containing water also helps urge the mortar out of the hopper through the extrusion ports. Mortar gate plate members to regulate flow of mortar through the extrusion ports are also provided.

7 Claims, 5 Drawing Sheets

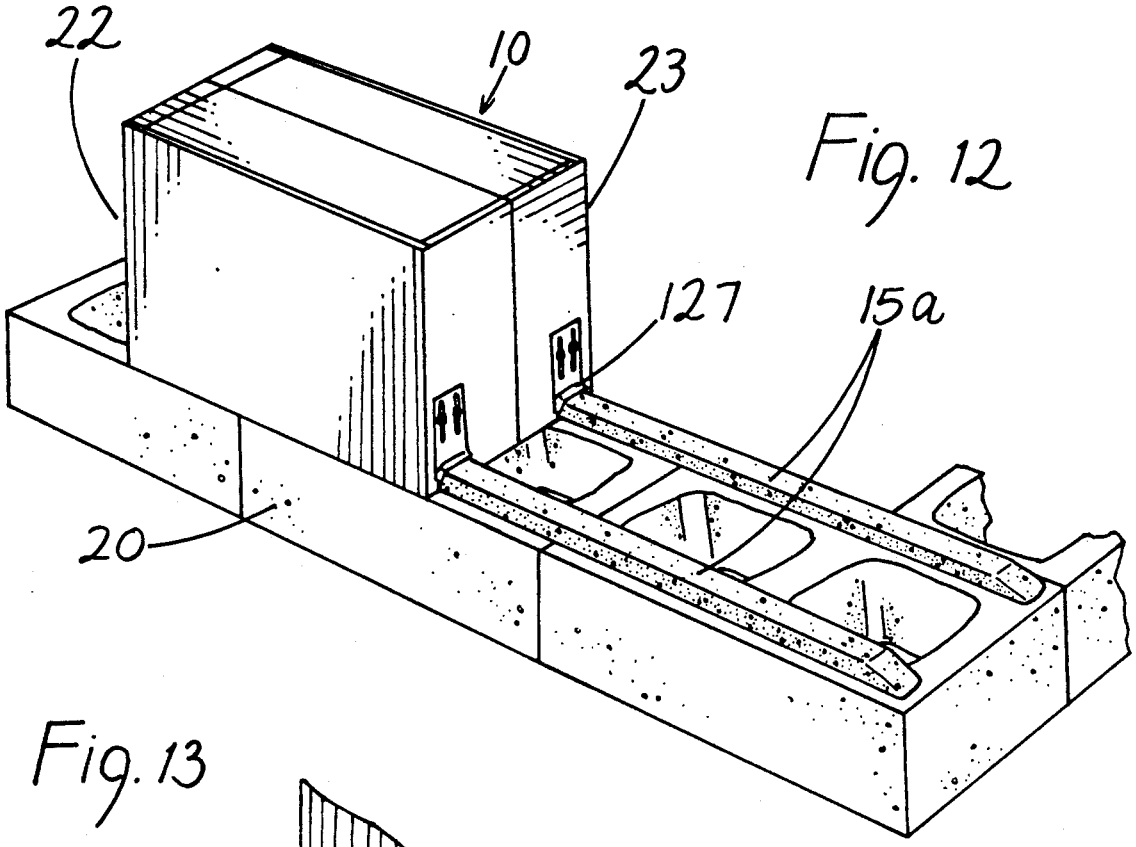
Fig. 12
Fig. 13
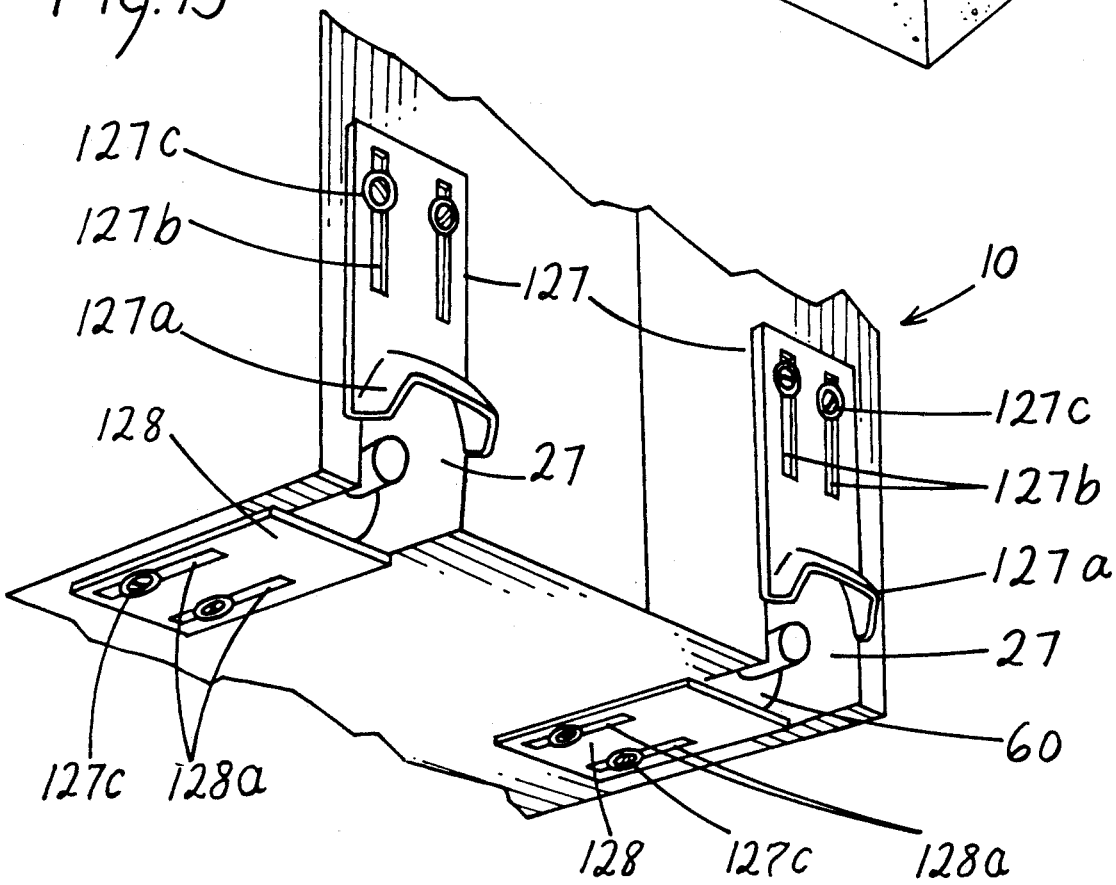

ADJUSTABLE APPARATUS FOR SPREADING MORTAR AND METHOD THEREFOR

This a continuation-in-part of co-pending application Ser. No. 07/164,438 filed on Mar. 4, 1988, now abandoned.

BACKGROUND OF THE INVENTION

1. Field of the Invention

The present invention generally relates to an adjustable apparatus and method for spreading mortar and, more specifically, to an adjustable apparatus and method for spreading a double line of mortar on blocks or bricks of varied sizes used in masonry construction.

2. Description of the Prior Art

In the past, various devices were employed to spread mortar on a course of block or brick. However, none of the devices of the past are capable of adjustment to accommodate bricks or blocks of different widths. This drawback is critical because bricks and/or block are manufactured in a variety of standardized widths including four, six, eight and ten inches.

For example, Erp (U.S. Pat. No. 2,674,116 issued Apr. 6, 1954) discloses a mortar spreader provided with a pair of longitudinally extending closure flaps for guiding the mortar.

Tolbert et al. (U.S. Pat. No. 3,045,312 issued July 24, 1962) teach a machine for spreading mortar comprising a sliding feeder plate arranged along the bottom and side walls of a hopper portion.

Doll (U.S. Pat. No. 1,158,480 issued Nov. 2, 1915) presents a simply constructed mortar spreader that is equipped with an adjustable gate device for controlling the gravitational flow of mortar. The Doll spreader simply provides a holder and guide for the mortar.

Another mortar dispensing apparatus is disclosed by Searl (U.S. Pat. No. 2,758,468 issued Aug. 14, 1956). The Searl apparatus includes a slide valve, carried on a hopper, movable to open and close an opening through which the mortar is dispensed.

Maskrey and Sheldon (U.S. Pat. No. 1,125,146 issued Jan. 19, 1915) cooperatively teach yet another mortar spreader equipped with doors which are opened and closed by operation of a crank arm coupled with three angularly disposed cranks.

A mortar spreader is also presented by Ainslie (U.S. Pat. No. 1,780,902 issued Nov. 11, 1930). The Ainslie spreader is composed in part of a pivoting front wall which acts to control the gravitationally induced flow of mortar from the hopper portion thereof.

Molnar (U.S. Pat. No. 4,516,868 issued May 14, 1985) teaches a mastic applicator and adjustable blade assembly. The applicator is used to complete a joint between adjacent panels of drywall or sheet rock by delivering mastic over tape which is disposed over the joint area.

Garnett, Jr. (U.S. Pat. No. 3,148,432 issued Sep. 15, 1964) discloses yet another mortar spreader. The Garnett apparatus utilizes an electric motor to facilitate the dispersement of the mortar.

A mortar layer is taught by Villanovich (U.S. Pat. No. 3,887,114 issued June 3, 1975). In operation, the Villanovich layer requires the user to propel the device with one hand while turning a crank to dispense the mortar with the other hand.

Like Garnett, Meyer (U.S. Pat. No. 3,826,410 issued July 30, 1974) discloses an electric mortar spreader which requires connection with a power source.

A mortar applying device is shown by Hession et al. (U.S. Pat. No. 4,294,383 issued Oct. 13, 1981). The Hession et al. device is configured with a rectangular shaped hopper consisting of flat end-plates and secured to flat tapered side members by any suitable means such as welding.

Covington (U S. Pat. No. 915,661 issued Mar. 16, 1909) discloses a fertilizer distributer in a configuration resembling a wheelbarrow.

Cusumano et al. (U.S. Pat. No. 4,352,445 issued Oct. 5, 1982) reveal a building material applicator which is composed in part of a beater assembly having a plurality of paddles.

Foye (U.S. Pat. No. 3,791,559 issued Feb. 12, 1974) teaches a hopper-type mortar spreader in the same basic style as other of the above-referenced prior art. The Foye spreader employs roller shafts equipped with sprockets to engage a chain which is integral with the propelling action of the spreader.

However, none of the previous references teach a mortar applicating device which is adjustable in width to accommodate a variety of bricks and blocks. Therefore, a need exists for a mortar spreading apparatus which is readily adapted to bricks of differing widths.

SUMMARY OF THE INVENTION

It is an object of this invention to provide an apparatus and method for spreading mortar.

It is a further object of this invention to provide an apparatus and method for spreading mortar on brick or block of varied width.

It is another object of the subject invention to provide a mortar spreading apparatus which mechanically extrudes a desired amount of mortar in two beads.

It is a still further object of this invention to provide an adjustable mortar spreading apparatus and method which minimizes material waste.

Yet a further object of this invention is to provide a dual-purpose weighted cover containing water to wet the mortar as required during application and to also urge the material from the hopper.

Another subject of the invention is to provide a trowel means at the extrusion ports to smooth the extruded mortar.

Still another object is to provide a gate plate means to regulate the amount of mortar being extruded.

The aforementioned and other objects are accomplished, according to the present invention, by providing an adjustable apparatus and method for spreading mortar as herein described.

The foregoing and other objects, features and advantages of this invention will be apparent from the following, more particular, description of the preferred embodiments of this invention, as illustrated in the accompanying drawings.

BRIEF DESCRIPTION OF THE DRAWINGS

FIG. 12 shows an embodiment of the present invention having vertically adjustable trowel means at the extrusion ports for shaping the mortar urged out by the auger upon the building block edges.

FIG. 13 shows a bottom view of the apparatus illustrated in FIG. 12 showing the gate plate for regulating the amount of mortar being deposited.

DESCRIPTION OF THE PREFERRED EMBODIMENT

Figure 1:
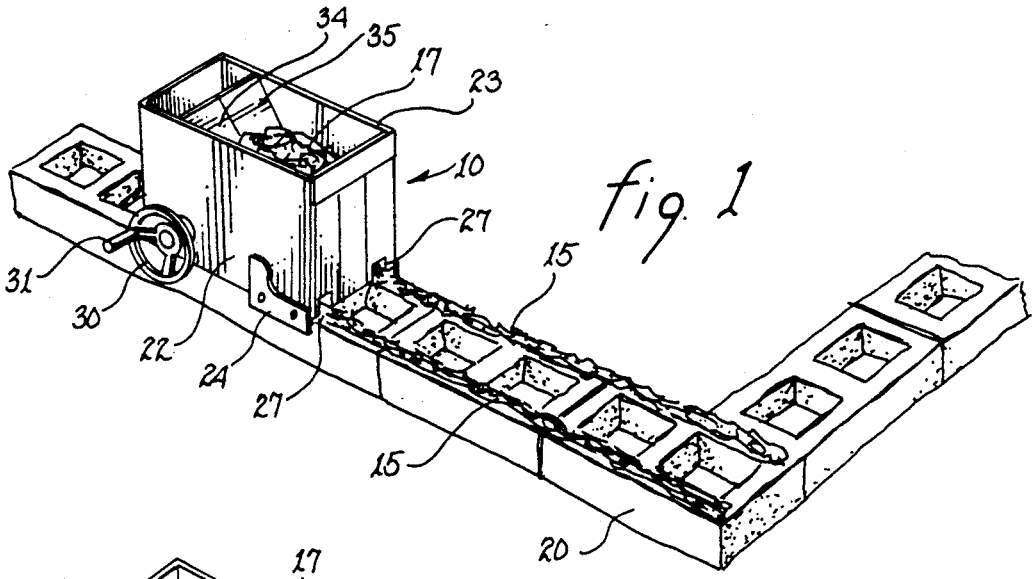
FIG. 1 is a perspective view of the present invention shown in active mode spreading two beads of mortar along a course of masonry.
Figure 2:
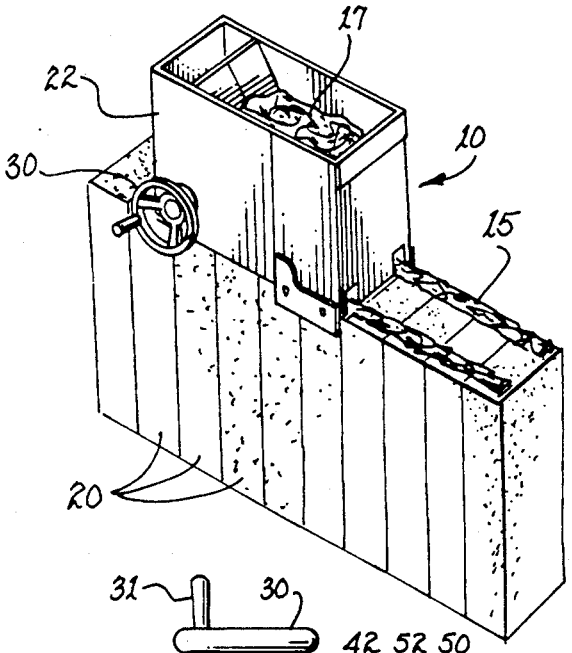
FIG. 2 is a perspective view of the present invention shown in active mode spreading two beads of mortar over one end of a row of aligned bricks or blocks.

Referring now to FIGS. 1 and 2 of the accompanying drawings which set forth the present invention in greater detail and in which like numerals designate like features, the apparatus for spreading mortar 10 is generally illustrated in unexpanded mode revealing the function thereof.

Figure 14:
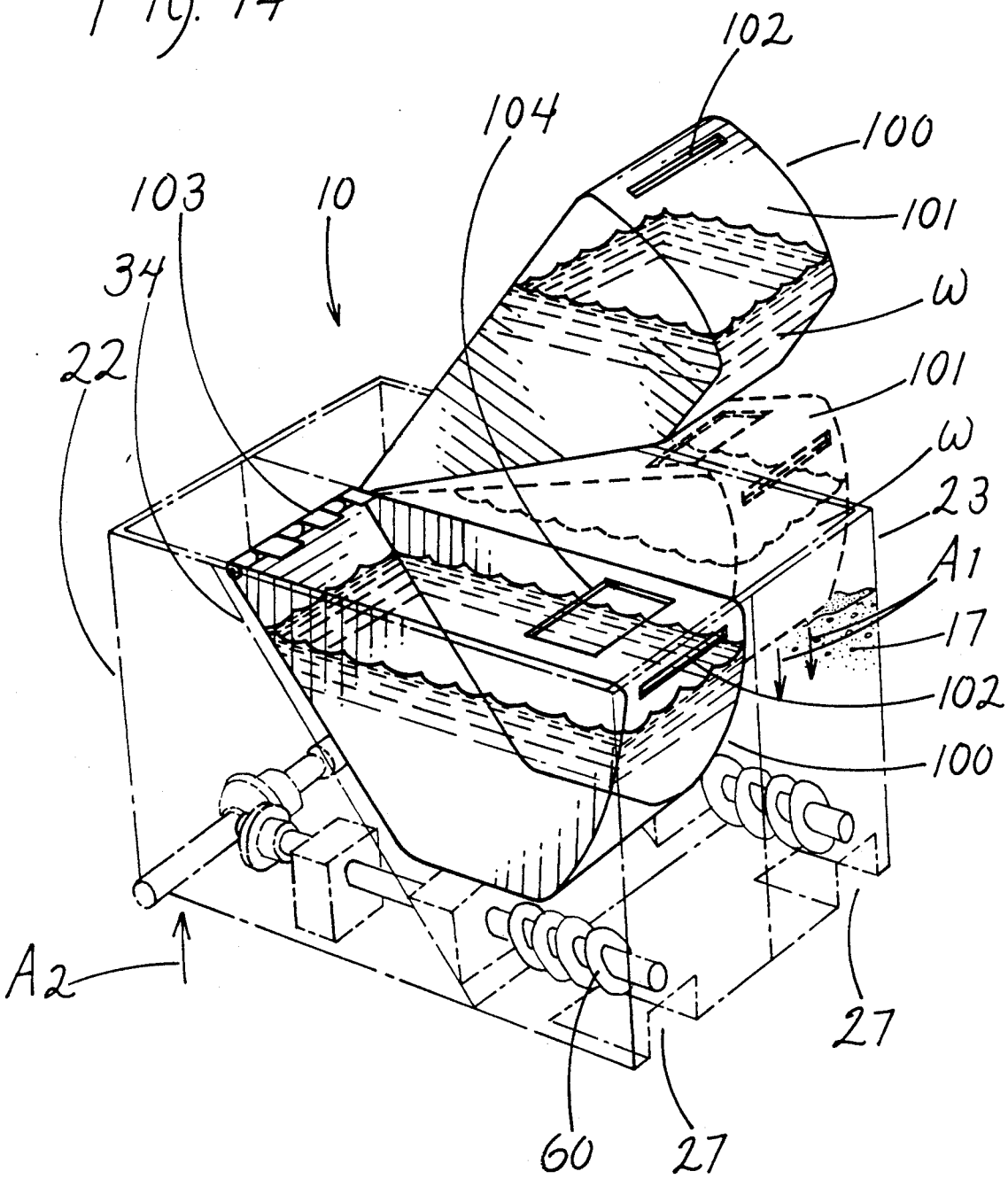
FIG. 14 shows a dual-purpose lid system comprising of two independent water tanks that help urge the mortar flow out the respective extrusion ports and that provide means for wetting the mortar in the hopper.

The apparatus 10 is, in part, comprised of a right side portion 23, a left side portion 22, a left baffle member 34, a right baffle member 35, a hand wheel 30, a hand wheel handle 31, and extrusion ports 27. The baffle members 34 and 35 are affixed to the inner portions of the side walls of the left and right side portions 22 and 23 respectively. The side portions 22 and 23 include front and back portions which oppose each other and which form 90° angles with the respective side walls so that front and back walls are defined. The embodiment shown in FIGS. 12, 13 and 14 comprises the additional features of lid members 100 attached by hinge means 103 proximate baffle members 34 and 35, a trowel means 127 having trowel portion 127*a* adjustably attached above extusion ports 27 by means of slot 127*b* and hardware 127*c* and a gate plate member 128 adjustably mounted beneath extrusion ports 27 by means of slot 128*a* and hardware 127*c*. The lid members 100 are multi-purpose in that in addition to serving as a lid to cover the respective partitions of the hopper, the lid design includes a tank 101 having fill opening 104 for storing a volume of water W which can be poured out through opening 102 by slightly raising the front end (hand wheel end) of apparatus 10 as indicated by direction arrow A2 in FIG. 14. The water is intended for occasional use to wet mortar 17 as required, but also its weight also serves to urge the mortar 17 through extrusion ports 27. Gate plate member 128 is adjustable to regulate the amount of mortar being deposited. The trowel means is provided to produce a smooth surface on mortar bead 15*a* which will help retain the moisture and binding characteristics of the mortar prior to placing the block building material 20 upon the bead of mortar.

Figure 4:
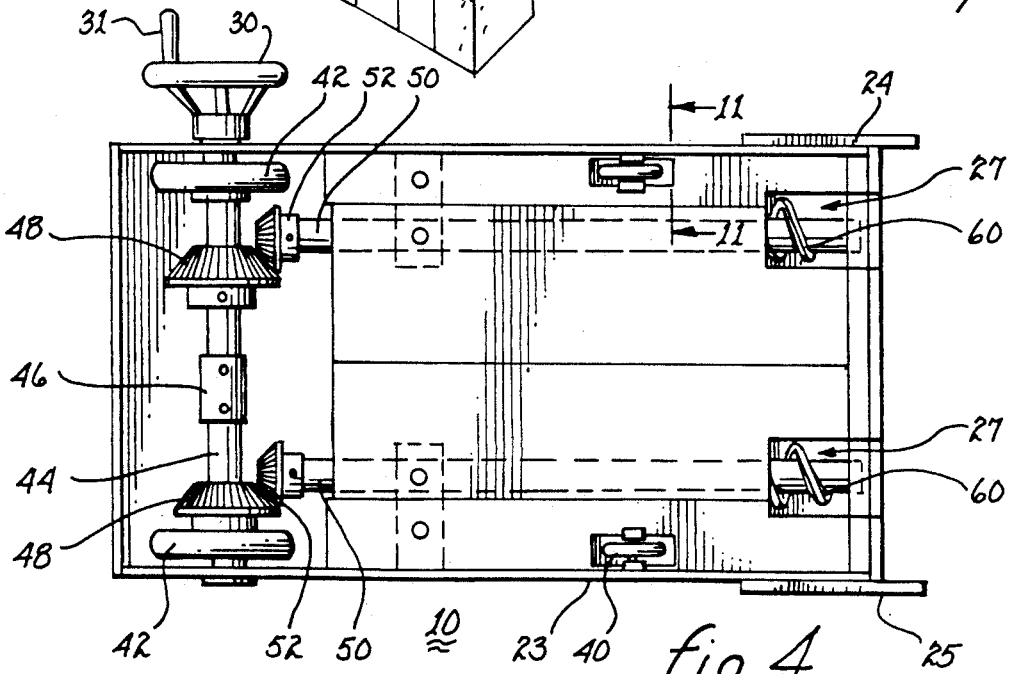
FIG. 4 is a bottom view of the present invention.
Figure 3:
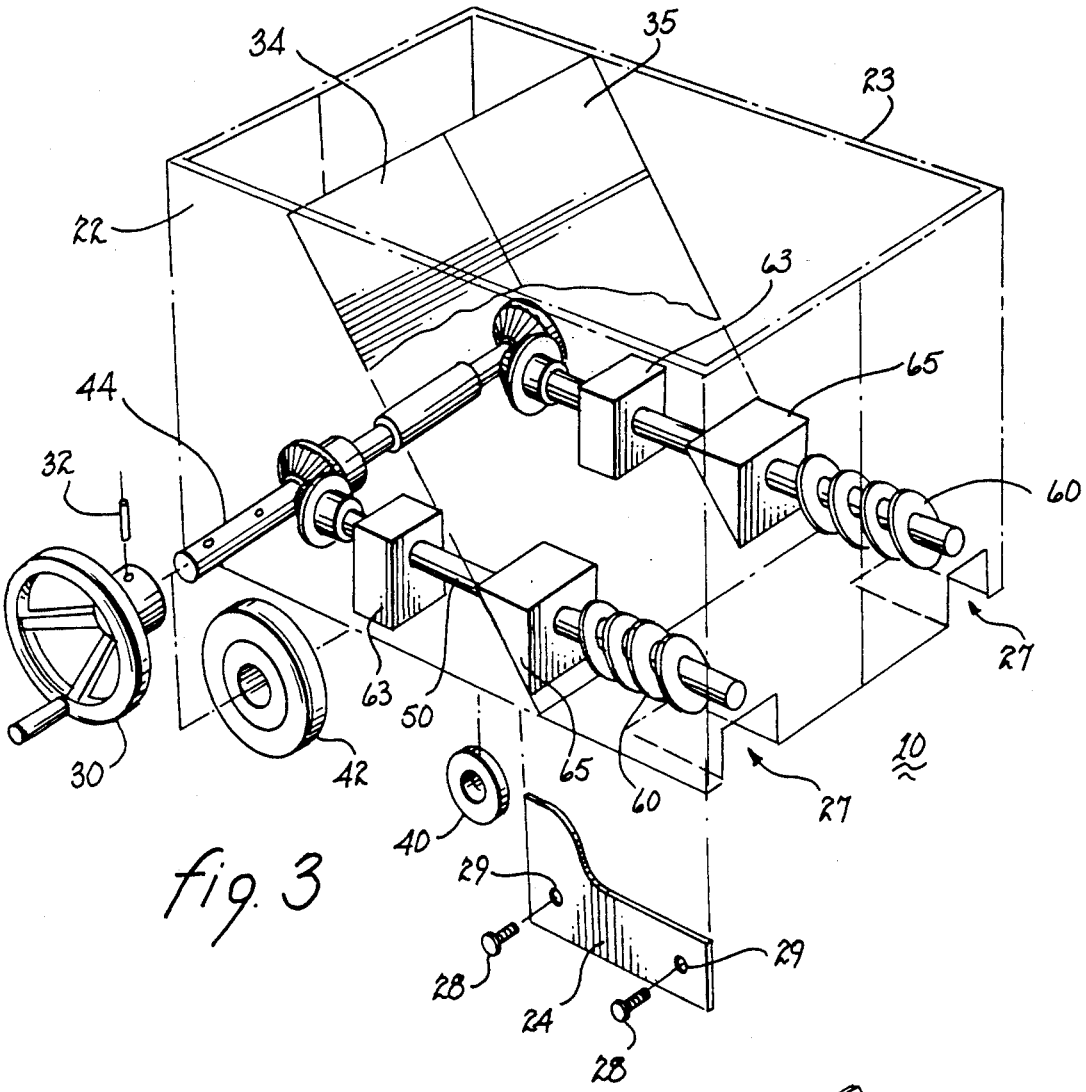
FIG. 3 is a partially blown-apart perspective view of the present invention illustrated in phantom to reveal an inner view.

Referring now to FIG. 4, front wheels 42 are positioned on a two-part axle 44 which is coupled together by a removable axle adjustment sleeve 46 and which is equipped with axle pinion gears 48. The axle pinion gears 48 cooperate with auger shaft gears 52 which are located at the front end of the auger shafts 50. The auger shafts 50 extend rearward and include auger blades 60 proximate to the extrusion ports 27. It is understood that the extrusion ports may be equipped with means to adjust the size therof in order to accomodate different requirements. Rear wheels 40 are positioned within slots in the two piece bottom plate member 38.

Figure 11:
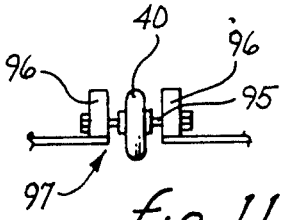
FIG. 11 is a partial cross-sectional view taken along the line 11—11 of FIG. 4 in the direction of the arrows.

As illustrated in FIG. 11, the rear wheels 40 is disposed within slot-shaped openings 97 in the bottom plate member 38 and are connected thereto by rear wheel axles 95 which are coupled with rear wheel axle support members 96.

FIG. 4 shows the relationship between the auger blades 60 and the extrusion ports 27. The auger shafts 50 extend through auger shaft support blocks 63 and auger shaft gusset blocks 65 which serve to rotatably maintain the shafts 50 in proper position. The hand wheel 30 is coupled to the axle 44 by a cotter pin 32 or other method of similar function. The guide members 24 and 25 may be attached to the side portions 22 and 23 with rivets 28 disposed through holes 29. It should be noted that the guide members 24 and 25 extend below the bottom plate 38 and beyond the rear wall of the apparatus 10 for reasons which will become apparent in the following discussion.

Figure 6:
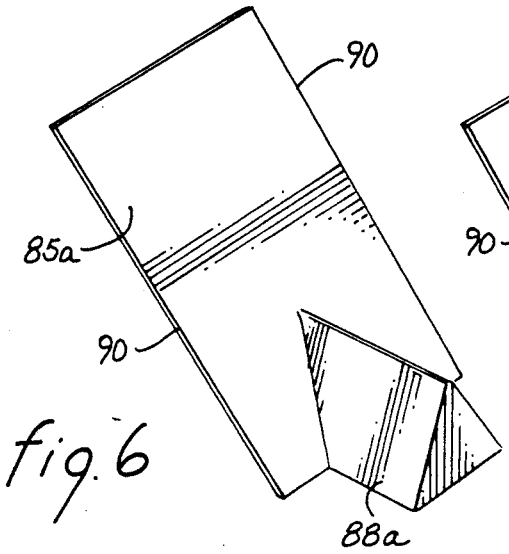
FIG. 6 is a perspective view of a baffle insert of the present invention.
Figure 7:
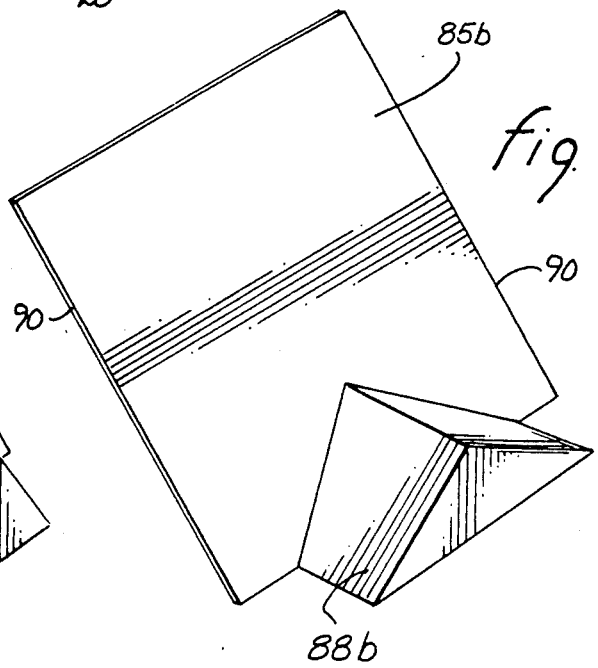
FIG. 7 is a perspective view of another baffle insert of the present invention.

FIGS. 6 and 7 illustrate two different baffle inserts 85*a* and 85*b* which include triangular-shaped diversion members 88*a* and 88*b* respectively and which have side portions 90.

Figure 5:
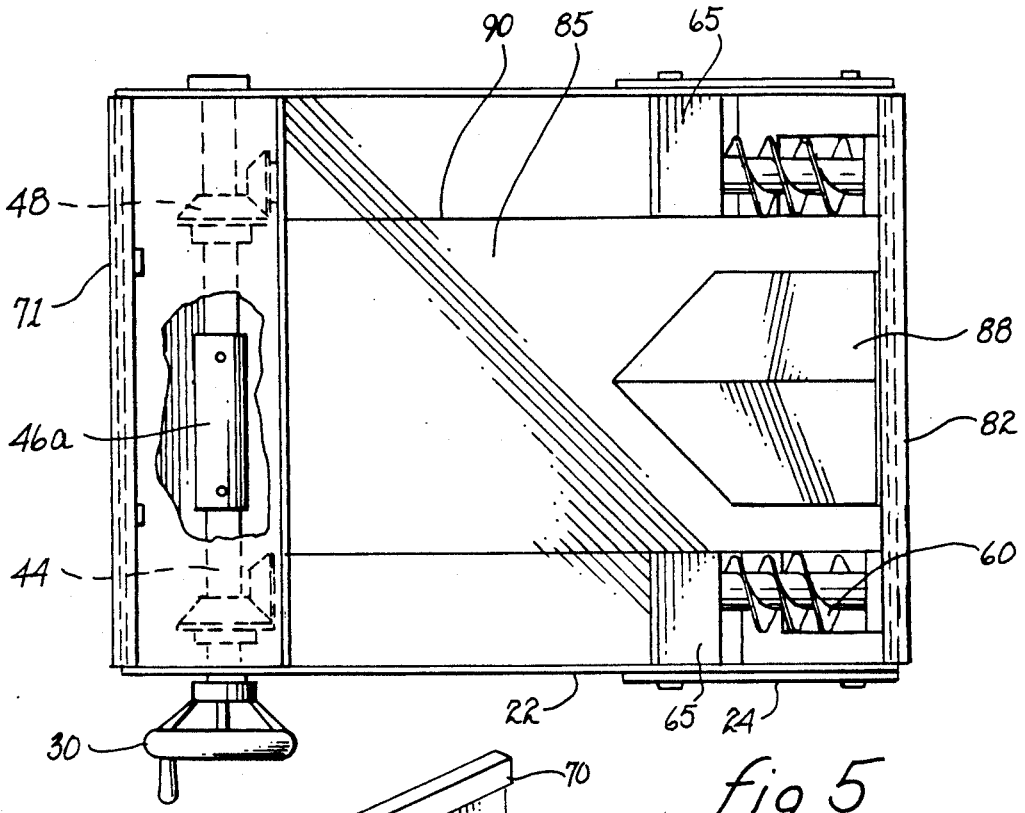
FIG. 5 is a top view of the present invention shown in expanded mode.

As shown in FIG. 5, the baffle insert 85 is placed in cooperating relationship with the left and right baffle members 34 and 35 when the apparatus 10 is in expanded mode. An expanded axle adjustment sleeve 46*a* connects (by cotter pins, not shown) the ends of the axle 44. It is understood that different types of axle connecting devices may be employed, and that the adjustment sleeve 46 configuration is for illustrative purposes.

Figure 8:
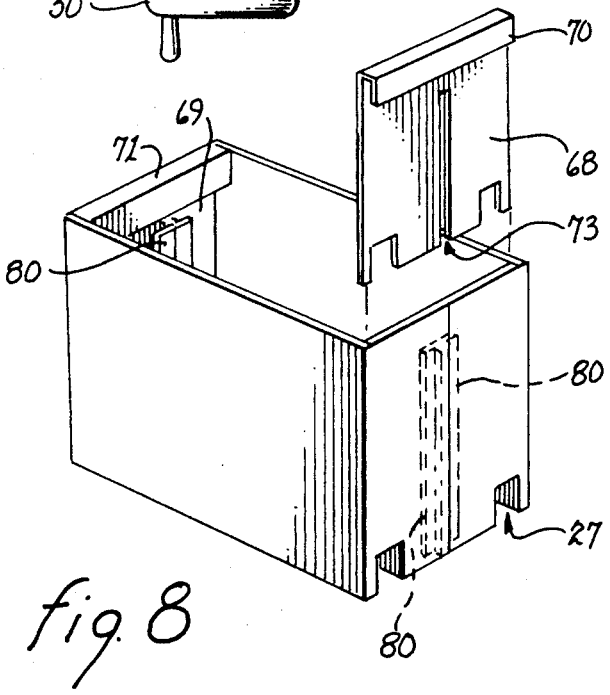
FIG. 8 is a partial perspective view of the housing of the present invention shown in unexpanded mode.

FIG. 8 includes a depiction of a rear wall connecting member 68 which includes a vertically oriented slot 73 and a lip portion 70. Akin to the rear wall connecting member 68, a front wall connecting member 69 includes a vertically oriented slot (not shown) and a lip portion 71. Both connecting members 68 and 69 are positioned so that the main portions thereof abut the interior of the end portions of the side members 22 and 23 which include vertically oriented lip portions 80. The slots 73 slidably cooperate with the lip portions 80 to hold the side portions 22 and 23 together. The connecting members 68 and 69 are detachably disposed by sliding them downwardly so that the slots 73 engage the lip portions 80.

Figure 9:
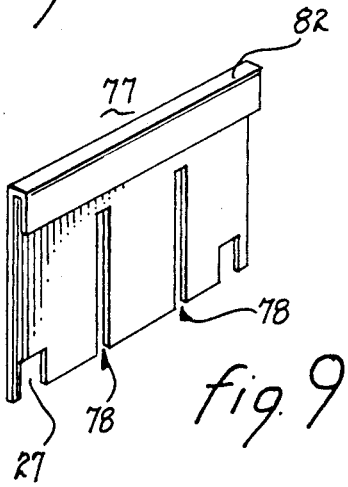
FIG. 9 is a perspective view of an insert rear end panel.

An extended back wall connecting member 77 with lip portion 82 is shown in FIG. 9 and it is understood that a similar extended wall connecting member is utilized on the front wall of the apparatus 10 The extended wall connecting members 77 have two slots 78 and are greater in width than the back wall connecting member 68 and therefore serve to create a spreader apparatus of greater width.

Figure 10:
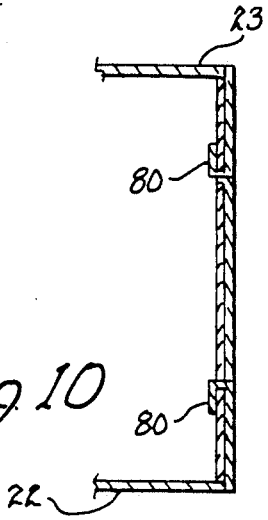
FIG. 10 is a cross-sectional top view of an end portion of the subject invention in expanded mode.

As best shown in FIG. 10, the slots 78 engage the lip portions 80 of the side portions 22 and 23 to define the rear wall of the apparatus 10; and the front wall is similarly defined.

SYSTEM OPERATION

In operation, the apparatus 10 is positioned over a row of blocks 20 and mortar 17 is placed in the hopper area defined by the baffle members 34 and 35, the side portions 22 and 23, and the back wall connecting member 68. The guide members 24 and 25 extend downward over a top portion of the blocks 20 to ensure that the apparatus 10 does not deviate sideways from its intended path.

Once the mortar 17 is placed in the hopper area, the operator primes the auger blades by lifting slightly on the front end of the apparatus 10 to disengage the front wheels 42 from the upper surface of the blocks and then turning the hand wheel 30 in a counterclockwise direction until mortar appears in the extrusion ports 27.

The apparatus 10 is then moved forward while the front wheels 42 engage the blocks 20 thereby turning the axle 44 which imparts rotation on the auger shafts 50 causing the mortar 17 to be extruded in beads 15 which are maintained on top of the blocks 20 due to the guide members 24 and 25 extending beyond the rear wall of the apparatus 10. In the embodiment shown in FIG. 12, mortar 17 is extruded to produce smooth surface beads 15*a* due to the smoothing action of trowel means 127. Alternatively, the operator may turn the hand wheel 30 to create the same function. It is also understood that a motor (not shown) may be utilized to create the forward motion of the apparatus 10.

Bricks and/or blocks commonly used in masonry are generally produced in widths of 4, 6, 8, and 10, inches. Therefore, the present invention contemplates adjustability to accommodate those widths, as well as the ability to customize to fit special width blocks. This adjustment is accomplished by the use of adjusting inserts.

The front and rear walls of the apparatus are extended by the use of the extended wall connecting members 77, the baffle portion of the hopper is widened by the insertion of a baffle insert 85, and the axle 44 is lengthened through the use of a longer axle adjustment sleeve 46*a*.

The extended wall connecting members 77, the baffle inserts 85, and the axle adjustment sleeves 46*a* are intended to be supplied in groups to accomplish the width adjustment. In other words, the extending elements 77, 85 and 46*a* will be supplied in 2, 4, and 6 inch versions to accomplish the expansion of the apparatus 10 from unexpended mode, which accommodates 4 inch block, to 6, 8, and 10, inch expanded modes.

The baffle inserts 85 are equipped with a triangular-shaped diversion member 88 which gravitationally directs the mortar 17 toward the auger blades 60. The baffle inserts 85 are simply laid in position on the baffle members 34 and 35 and are held in position because the edges thereof 90 abut the inwardly facing surfaces of the auger shaft gusset blocks 65. In the embodiment shown in FIG. 14 lid members 100 having tank member 101 filled with water W, the mortar 17 is urged in the direction of arrows A1 due to the weight of the respective tanks 101 in the hopper. The embodiment shown in FIG. 13 provides gate plate member 128 that can be adjustably positioned to regulate the amount of mortar being deposited.

The apparatus 10 is utilized to place beads of mortar 15 on top of a course of blocks 20 (as shown in FIG. 1) to receive another course of blocks 20 thereon. As shown in FIG. 2, the apparatus 10 is also employed to extrude beads of mortar 15 on one end of the blocks 20 to be used in the next course. Once the beads 15 have been placed, the blocks 20 for the next course are placed end to end on top of the lower course. In this manner, the present invention allows a mason to lay the bricks or block without manually placing mortar 17 thereon.

While the invention has been particularly shown and described in reference to the preferred embodiments thereof, it will be understood by those skilled in the art that changes in form and details may be made without departing from the spirit and scope of the invention. The term block as used in the claims is intended to mean any block or brick type material.

What is claimed is:

1. An adjustable apparatus for spreading mortar comprising:

hopper means including at least one opening for containing said mortar, said hopper means further including a first expansion means for accommodating a plurality of widths of masonry block building material, said first expansion means including opposed, detachable wall extending connecting members;

hinged lid means for covering said hopper means, said lid means including a tank member for containing water used for wetting said mortar, said tank member being in gravitational contact with said mortar in said hopper for aiding extrusion of said mortar from said hopper;

extrusion means operably coupled to said hopper means for extruding at least one bead of said mortar from said hopper means onto block building material, said extrusion means comprising at least one auger having auger shaft gears at one end;

drive means having axle pinion gears operably coupled to said auger shaft gears on said extrusion means for driving said extrusion means, said drive means comprising at least one wheel operably coupled to said at least one auger by means of an axle and having a second expansion means comprised of an axle adjustment sleeve coupled to said axle for accommodating a plurality of widths of masonry block building material;

trowel means for smoothing said bead extruded from said hopper, said trowel means being adjustably mounted above extrusion ports provided on said hopper means;

gate plate means for regulating amount of mortar being deposited onto said block building material; and guide means positioned proximate to said extrusion means for positioning said apparatus and for directing said at least one bead of said mortar.

2. A method of spreading mortar on a plurality of width of masonry block building material, said method comprising the steps of:

providing hopper means adapted with extendable wall means for accommodating said plurality of widths of masonry block building material, said hopper means including at least one opening for containing said mortar;

providing hinged lid means for covering said hopper means, said lid means including a tank member for containing water used for wetting said mortar, said tank member being in gravitational contact with said mortar in said hopper for aiding extrusion of said mortar from said hopper;

providing extrusion means having at least one auger having auger shaft gears at one end and being operably coupled to said hopper means for extruding at least one bead of said mortar from said hopper means onto block building material;

providing drive means having axle pinion gears operably coupled to said auger shaft gears on said extrusion means for driving said extrusion means, said drive means comprising at least one wheel operably coupled to said at least one auger by means of an axle and having an expansion means comprised of an axle adjustment sleeve coupled to said axle for accommodating said plurality of widths of masonry block building material;

providing trowel means for smoothing said bead extruded from said hopper, said trowel means being adjustably mounted above extrusion ports provided on said hopper means;

providing gate plate means for regulating amount of mortar being deposited onto said block building material;

providing guide means positioned proximate to said extrusion means for positioning said apparatus and for directing said at least one bead of said mortar;

providing groups of said extendable wall means having different widths;

selecting appropriate extendable wall means from said provided group of extendable wall means according to a width of masonry block being used;

adjusting the width of said hopper means;

placing said mortar in said hopper means;

operating said drive means causing said axle coupled to said at least one wheel to rotate and produce forward motion; and engaging said axle pinion gears with said auger shaft gears and driving said extrusion means and extruding and troweling said mortar from said hopper means onto block building material.

3. A method of spreading mortar as recited in claim 2, said method further comprising the steps of:

urging said mortar from within said hopper as a result of said tank member being in gravitational contact with said mortar in said hopper;

adjusting size of said extrusion port for regulating amount of mortar being deposited onto said block building material using said gate plate means; and adjusting height of said trowel means to compensate for amount of said mortar bead being deposited on said building block material.

4. A method of spreading mortar as recited in claim 2, said method further comprising the step of:

raising an end of said hopper to pour water contained in said tank member for wetting said mortar in said hopper.

5. An adjustable apparatus for spreading mortar comprising:

hopper means including at least one opening for containing said mortar, said hopper means further including a first expansion means for accommodating a plurality of widths of masonry block building material, said first expansion means including opposed, detachable wall extending connecting members;

extrusion means operably coupled to said hopper means for extruding at least one bead of said mortar from said hopper means onto block building material, said extrusion means comprising at least one auger having auger shaft gears at one end;

drive means having axle pinion gears operably coupled to said auger shaft gears on said extrusion means for driving said extrusion means, said drive means comprising at least one wheel operably coupled to said at least one auger by means of an axle and having a second expansion means comprised of an axle adjustment sleeve coupled to said axle for accommodating a plurality of widths of masonry block building material;

hinged lid means for covering said hopper means, said lid means including a tank member for containing water used for wetting said mortar, said tank member being in gravitational contact with said mortar in said hopper for aiding extrusion of said mortar from said hopper; and guide means positioned proximate to said extrusion means for positioning said apparatus and for directing said at least one bead of said mortar.

6. An adjustable apparatus for spreading mortar as recited in claim 5, further comprising:

trowel means for smoothing said bead extruded from said hopper, said trowel means being adjustably mounted above extrusion ports provided on said hopper means.

7. An adjustable apparatus for spreading mortar as recited in claim 5, further comprising:

gate plate means for regulating amount of mortar being deposited onto said block building material.

* * * * *